United States Patent [19]

Bennett et al.

[11] 4,036,611

[45] July 19, 1977

[54] ELECTRODE HANGER ALIGNING DEVICE

[75] Inventors: Robert L. Bennett, Louisville; Orville C. Parrott, Fern Creek; Allan R. Getzin; A. Ervin McClain, both of Louisville, all of Ky.

[73] Assignee: American Air Filter Company, Inc., Louisville, Ky.

[21] Appl. No.: 670,270

[22] Filed: Mar. 25, 1976

[51] Int. Cl.[2] ..... B03C 3/86

[52] U.S. Cl. ..... 55/149; 339/263 E; 339/264 R

[58] Field of Search ..... 55/140, 147, 148, 112, 55/113, 149; 339/263 R, 263 E, 264 R; 248/226 A, 316 R; 314/130, 134

[56] References Cited

U.S. PATENT DOCUMENTS

| | | | |
|---|---|---|---|
| 720,772 | 2/1903 | Baggett | 314/130 |
| 3,594,703 | 7/1971 | Holtzapple | 339/264 R |
| 3,835,623 | 9/1974 | Kline | 55/148 |

FOREIGN PATENT DOCUMENTS

| | | | |
|---|---|---|---|
| 263,123 | 11/1965 | Australia | 55/140 |
| 1,058,023 | 5/1959 | Germany | 55/148 |
| 1,102,843 | 3/1961 | Germany | 339/264 R |
| 1,125,143 | 8/1968 | United Kingdom | 339/204 R |

*Primary Examiner*—Frank W. Lutter
*Assistant Examiner*—David L. Lacey

[57] ABSTRACT

An electrode hanger aligning device having a handle member attached thereto, the electrode hanger receiving member including first means to receive an electrode hanger therein and second means for aligning the electrode hanger.

2 Claims, 1 Drawing Figure

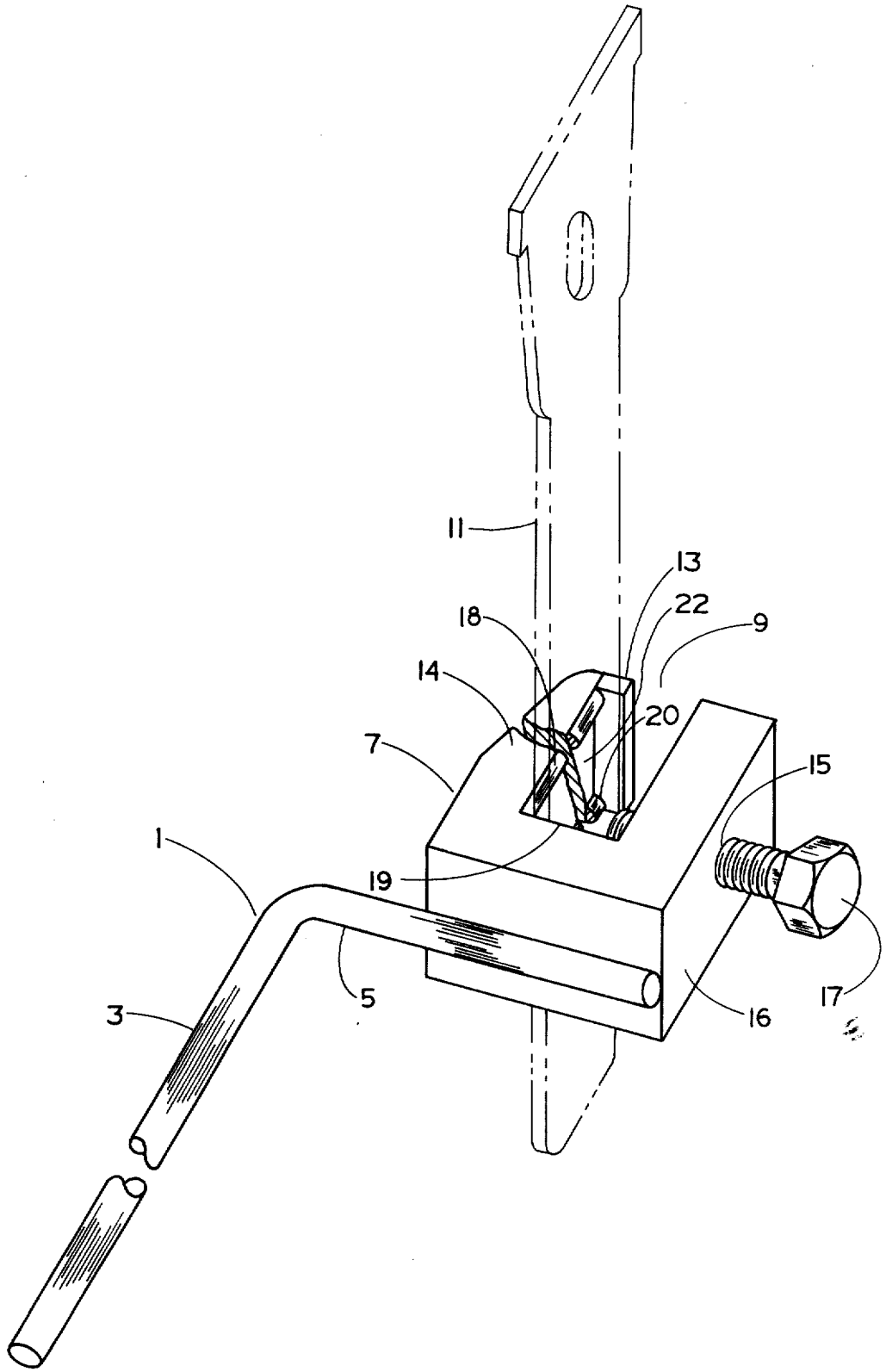
11
13
22
9
18
14
20
7
15
1
19
5
3
16
17

ELECTRODE HANGER ALIGNING DEVICE

BACKGROUND OF THE INVENTION

The present invention relates to an electrode hanger aligning device and more specifically relates to an electrode hanger aligning device for aligning or straightening discharge electrodes of an electrostatic precipitator.

In conventional electrostatic precipitator construction, it has generally been the practice to suspend discharge electrodes from a current carrying support means utilizing an electrode hanger as the connecting means between the current carrying support means and the discharge electrodes. Generally, the precipitator electrodes are connected to the electrode hangers and are weighted at their lower ends to maintain the electrodes in vertical alignment within the electrostatic precipitator. However, if the electrode hanger, such as the one described in U.S. Pat. No. 3,835,623, becomes bent during operation, either from the normal wear or tear or the swinging and swaying of the weighted electrodes, or if the electrical support members to which the electrode hangers are attached are not properly aligned, the weighted end of the electrode does not provide means to establish proper vertical alignment.

SUMMARY OF THE INVENTION

This invention provides an electrode hanger aligning device and further provides for a simple, easily constructed and effective device for aligning electrode hangers in place in an electrostatic precipitator.

More particularly, the present invention provides an electrode hanger aligning device comprising: a handle member; and, an electrode hanger aligning member attached to the handle member, the electrode hanger aligning member having first means therein to receive an electrode hanger therein and a second means for aligning said electrode hanger.

It is to be understood that the description of the examples of the present invention given hereinafter are not by way of limitation and various modifications within the scope of the present invention will occur to those skilled in the art upon reading the disclosure set forth hereinafter.

Referring to the drawing:

The FIGURE is a perspective view, partially cutaway, of an electrode hanger aligning device of the present invention.

The FIGURE of the drawing illustrates one preferred structure of an electrode hanger aligning device of the present invention. The electrode hanger aligning device of the present invention includes an L-shaped handle member 1, generally constructed from a relatively short rod of mild steel, with a lever portion 3 and a base portion 5. The base portion 5 is attached, by welding, to an electrode hanger engaging member 7, which is of substantially U-shaped cross section. The U-shaped hanger engaging member 7 is provided with a slot 9 therein having a base portion 19 to receive an electrode hanger 11, as shown by phantom lines, therethrough, electrode hanger 11 being generally flat, but shaped to engage tabs (not shown) of an electrical conducting or support device. The U-shaped hanger engaging member 7 is also provided with an inwardly extending lip portion 13 on leg 14 thereof, the lip 13 being disposed at the upper extremity of the slot 9. The opposed leg 16 is provided with a threaded aperture portion 15 extending therethrough, the threaded aperture 15 being disposed to receive an adjustable threaded member therethrough, the threaded member being exemplified as a threaded bolt member 17.

The distance between the lip 13 and the base portion 19 of the slot 9 is substantially the same as the width of the elongated portion of the electrode hanger 11 thereby alleviating play within the slot 9 of the electrode hanger 11 when straightening or aligning the hanger 11.

Along the inner wall of leg 14 is a pair of elongated ridges 18 and 20 disposed along opposed edges of slot 9 between lip 13 and the base portion 19. Ridges 18 and 20 define with the inner wall of leg 14 a groove or forming recess 22 therebetween, recess 22 receiving the bolt member 17 therein upon inward rotation of the bolt member 17.

With the electrode hanger 11 inserted into the slot 9, upon inward rotation of the bolt member 17, the bolt member 17 engages with the hanger 11 forcing the engaged portion into the recess 22. This forcing bends the hanger 11 into the desired alignment. Thus, in operation, the electrode hanger 11, while in place in an electrostatic precipitator, may be aligned or straightened in place by inserting the hanger 11 within the slot 9 between the lip 13 and the base portion 19 and adjusting member 17 as hereinbefore described.

It will be realized that various changes may be made to the specific embodiment shown and described without departing from the principals and scope of the present invention.

What is claimed is:

1. In combination with an electrode hanger for an electrostatic precipitator, an electrode hanger aligning device comprising: a handle member and a hanger engaging member attached to said handle member, said hanger engaging member including means receiving said electrode hanger therein and means in said means receiving said electrode hanger aligning said electrode hanger, said hanger engaging member being of U-shaped cross-section, said hanger engaging member including an inwardly extending lip portion at the upper extremity of one leg of said hanger engaging member, the leg opposed to said one leg including said lip includes a threaded aperture therethrough; said means aligning said electrode hanger being a threaded adjusting member rotatably mounted within said threaded aperture in combination with a forming recess in said one leg including said lip, said forming recess receiving said adjusting member with said electrode hanger disposed therebetween.

2. The combination of claim 1 wherein the distance between said lip of said U-shaped hanger engaging member and the base portion of a slot defined by upwardly extending legs of said U-shaped member is substantially equal to the width of said electrode hanger received within said slot.

* * * * *